US005645370A

United States Patent [19]

Zürbes et al.

[11] Patent Number: 5,645,370

[45] Date of Patent: Jul. 8, 1997

[54] VIBRATION TAMPER

[75] Inventors: Arno Zürbes, Bruchweiler; Helmut Rötsch, Beltheim, both of Germany

[73] Assignee: Bomag GmbH, Boppard, Germany

[21] Appl. No.: 535,880

[22] Filed: Sep. 28, 1995

[30] Foreign Application Priority Data

Oct. 10, 1994 [DE] Germany ..... 44 36 081.9

[51] Int. Cl.[6] ..... E01C 19/34

[52] U.S. Cl. ..... 404/133.1; 404/133.05

[58] Field of Search ..... 404/133.05, 133.1; 173/170, 102.2

[56] References Cited

U.S. PATENT DOCUMENTS

| | | | |
|---|---|---|---|
| 3,308,728 | 3/1967 | Brown | 404/133.1 |
| 3,538,821 | 11/1970 | Baumers et al. | 404/133.1 |
| 3,856,426 | 12/1974 | Waschulewski et al. | 404/133.1 |
| 4,014,620 | 3/1977 | Vural et al. | 404/133.1 |
| 4,186,197 | 1/1980 | Tetsuo | 404/133.1 |
| 4,557,336 | 12/1985 | DeNise | 404/133.1 X |
| 4,895,478 | 1/1990 | Artzberger | 404/133.1 |
| 5,340,233 | 8/1994 | Motl | 404/133.05 X |

FOREIGN PATENT DOCUMENTS 1179 876 10/1964 Germany .

*Primary Examiner*—Frank Tsay
*Assistant Examiner*—Frederick L. Lagman
*Attorney, Agent, or Firm*—Panitch Schwarze Jacobs & Nadel, P.C.

[57] ABSTRACT

A vibration tamper for packing soil has a guide handle elastically hinged on a tamper head of the tamper. The pivot point of the guide handle is located on the tamper head above an imaginary perpendicular extending from the grip area of the handle to the tamper longitudinal axis, and/or the handle has a special distribution of mass with regard to its pivot point.

10 Claims, 4 Drawing Sheets

VIBRATION TAMPER

FIELD OF THE INVENTION

The invention concerns a tamper for soil packing which executes near vertical vibrations through a built-in drive and for that purpose is to be held by an operator by means of an guide handle elastically hinged or pivoted at the tamper head and having a grip at the other end, wherein the guide handle has an extension which runs beyond its pivot point.

BACKGROUND OF THE INVENTION

Such tampers are known in numerous embodiment variants and have proven themselves well in packing small surfaces. Owing to the guide handle, the operator is in a position to guide the vibrating tamper over the ground surfaces to be packed in the desired direction and at the desired speed with little expenditure of energy. The extension of the guide handle at the opposite end from the grip serves as a protective device and as an additional grip in transporting the tamper.

In all cases the vibrations of the tamper are also transmitted to the guide handle. The operator is hence more or less often forced to take a break according to the strength and frequency of the vibrations and depending on the quality of the damping element between the guide handle and the tamper.

SUMMARY OF THE INVENTION

In view of the foregoing, an object of the present invention resides in improving known tampers such that the guiding handle lies more easily in the hand with equal packing performance of the packer, whereby the operator is subject to less stress, and interruptions of operation can be reduced. The control and steering capability of the tamper should be retained therewith to the full extent.

This object is achieved according to the invention by mounting the pivoting point of the guide handle on the tamper head above an imaginary perpendicular extending from the grip area of the handle to the tamper longitudinal axis and/or by the distribution of mass of the handle, taking the pivot point as the imaginary dividing point, complying with the following mathematical equation:

$$\frac{m_V \cdot l_V \cdot l_{VG}}{m_B \cdot l_B \cdot l_{BG}} = 0.6 - 1.5$$

wherein $m_V$=mass of the extension plus attached parts, $m_B$=mass of the guide handle plus attached parts extending from the pivot point to the grip, $I_V$=distance between the center of gravity of $m_V$ and the pivot point, $l_B$=distance between the center of gravity of ms and the pivot point, $l_{VG}$=distance between the center of gravity of $m_V$ and the grip, $l_{BG}$=distance between the center of gravity of $m_B$ and the grip.

Applicants have conducted extensive experiments with regard to the vibration transmission by the tamper to the guide handle and have come to the conclusion therefrom that not so much the elastic pivoting on the tamper but rather the position of the pivot point and/or the mass distribution of the guide handle have decisive influence upon the transmission of vibration. Applicants have surprisingly discovered that having an upward extension of the tamper in a manner such that the guide handle, or more exactly the connection between the grip and the pivot point, no longer, as was previously customary, stands vertically in relation to the longitudinal axis of the tamper, but only presents an angle of about 70° to about 80° to the longitudinal axis of the tamper, results in a clear diminution of vibrations at the grip end of the guide handle. This is further supported by the center of gravity of the handle being shifted away from the grip area to the extent that a mass distribution of the guide handle corresponding to the aforementioned mathematical equation is satisfied. The dynamic rotation moments of the guide handle are thereby influenced in such a way that the translational and rotational motions, which are superimposed at the grip end, almost cancel each other out.

In a further development of the invention, it is recommended that the quotient for the aforementioned mathematical equation of the weight distribution be set between approximately 0.7 and 1.25, especially approximately 0.8 to 1.15, and that the position of the pivot point be established at least about 2 cm, preferably about 3 cm to 20 cm, and most preferably at least approximately 5 cm, above the imaginary perpendicular extending from the handle grip to the longitudinal axis of the tamper.

In this connection, it is particularly advantageous if the guide handle carries a counterweight on its extension which projects out over the tamper head, in order to realize the desired mass distribution. It has furthermore proven advisable to transpose the pivot point of the guide handle away from the longitudinal axis of the tamper in the direction of the grip area.

Finally, it is recommended that the pivot point of the guide handle on the tamper head be manifested by means of at least one elastic element with a graduated progressive spring characteristic. This graduated progressive spring characteristic can be realized through additional damping surfaces of the elastic element, which in their resting position are spaced from the holding handle and first come into working connection with it following a certain deflection of the guide handle.

BRIEF DESCRIPTION OF THE DRAWINGS

The foregoing summary, as well as the following detailed description of a preferred embodiment of the invention, will be better understood when read in conjunction with the appended drawings which show further features and advantages of the invention. For the purpose of illustrating the invention, there is shown in the drawings an embodiment which is presently preferred. It should be understood, however, that the invention is not limited to the precise arrangements and instrumentalities features shown, described and/or claimed. In the drawings:

DETAILED DESCRIPTION OF PREFERRED EMBODIMENT

Figure 1:
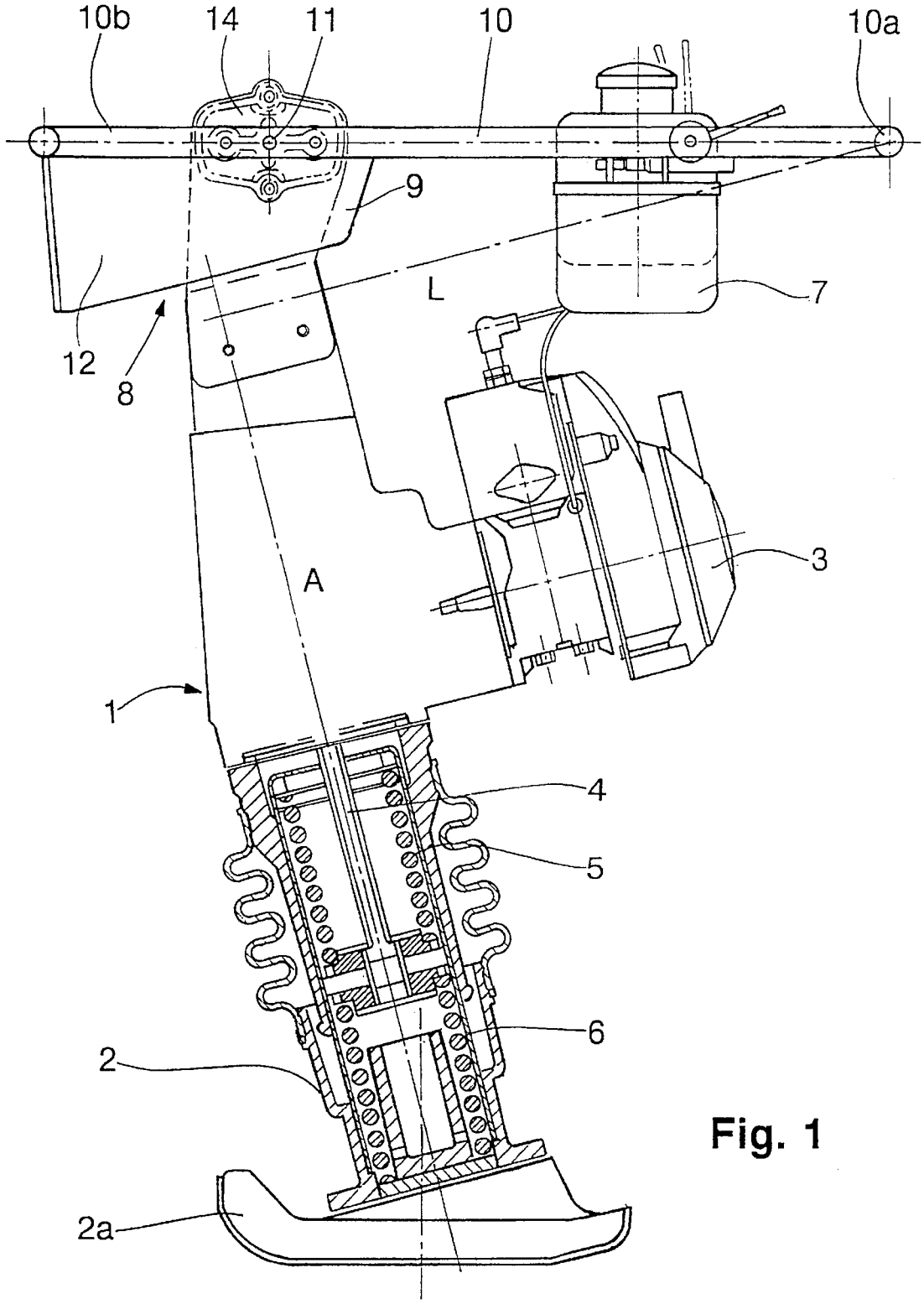
FIG. 1 is a side view of the tamper, partially in section.

The overall view in FIG. 1 shows a basically conventional vibration tamper 1 whose tamping foot 2 is put into nearly vertical vibrations by a liquid fuel motor 3. For this purpose, the motor 3 drives an eccentric (not illustrated in greater detail) upon which in turn a piston rod 4 is mounted, which is braced at its lower end with the tamping foot by means of prestressed springs 5 and 6.

The lower end of the tamping foot is formed by an obliquely attached tamping plate 2*a* so that the tamper stands slightly forwardly inclined, in the embodiment shown at an angle of about 75° Its equilibrium is ensured by the drive motor 3 as well as the fuel tank 7 being arranged on the other side of the tamper.

Figure 2:
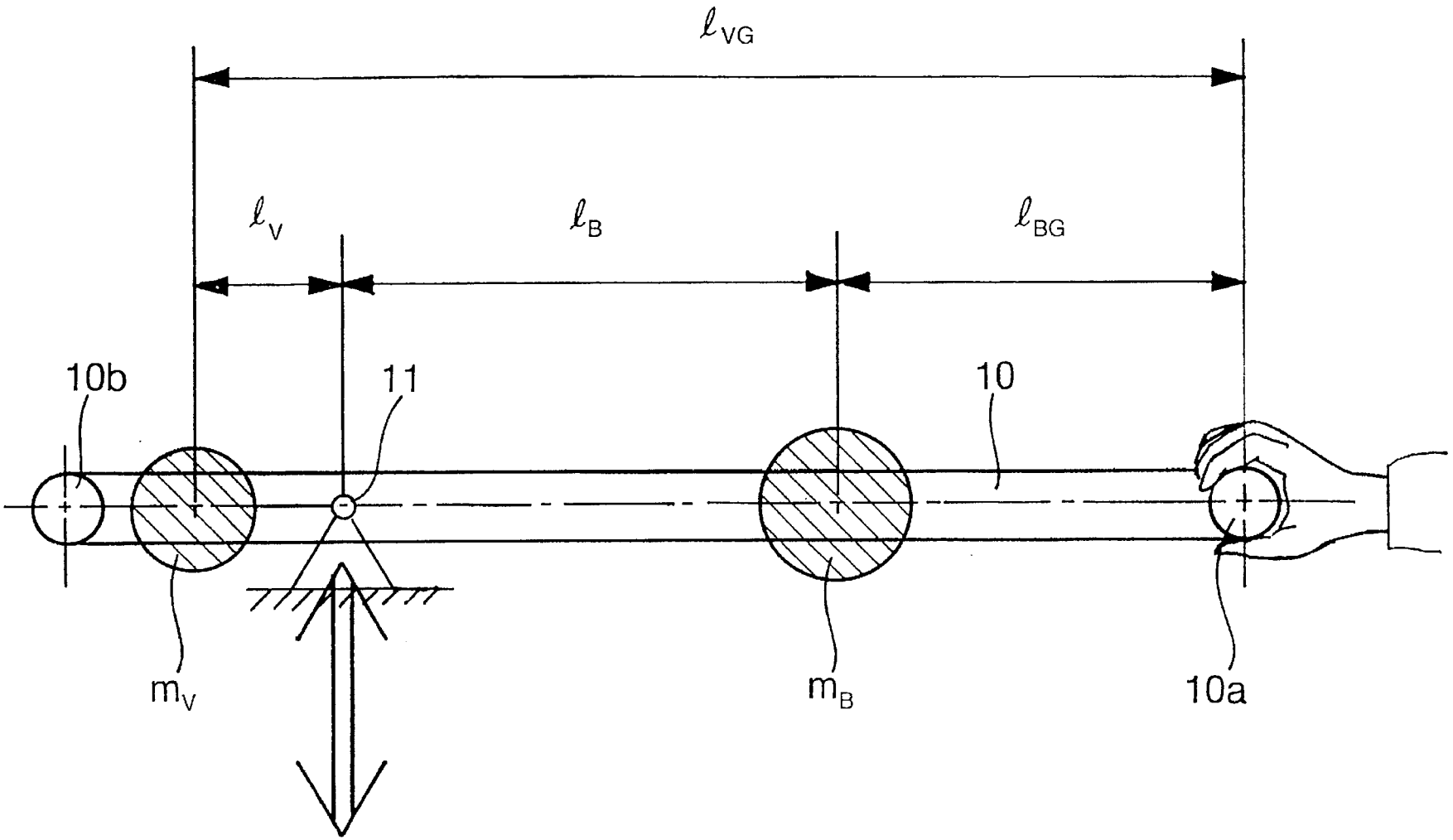
FIG. 2 is a schematic representation of the mass distribution of the guide handle.

First of all, it is essential that the holding handle have a certain mass distribution which complies with the mathematical equation indicated above, whereby reference is made to FIG. 2 for clarification of the individual masses and lever arms named therein. Guide handle 10 is there depicted with its pivot point 11, wherein the double arrow below the pivot point indicates the vibrations introduced. These vibrations do not run exactly vertically, but rather along a complicated curved path. Therefore the grip end 10*a* is exposed not only to movements in a vertical direction, but also in a horizontal direction. These motions are reduced or eliminated in a surprising manner by the mass distribution in accordance with the invention.

Figure 3:
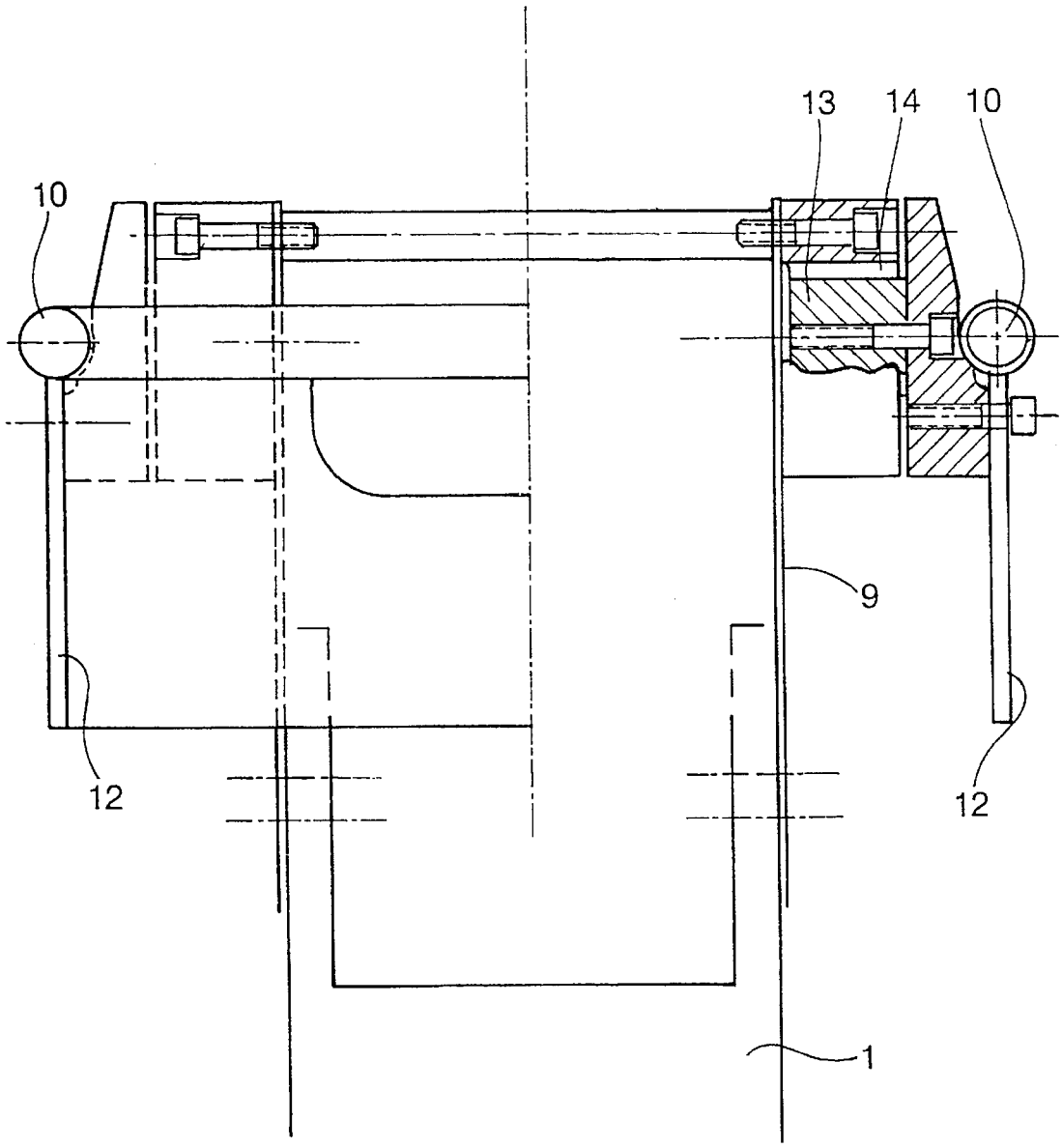
FIG. 3 is an enlarged front view of the tamper head, partially in section.

Secondly, it is essential that the construction of the tamper head 8 be extended upward by an attachment 9 (see also FIG. 3) and that the guide handle 10 be carried in this raised area. At the same time, the attachment 9 is tilted backward in relation to the tamper longitudinal axis, that is toward the operator. The pivot point 11 of the guide handle 10 on the tamper head is thereby not only extended upwardly in comparison with traditional tampers, but is also shifted in the direction of the operator. The pivot point therefore lies above the perpendicular L extending from the grip 10*a* of the guide handle 10 to the tamper longitudinal axis A (see FIG. 1). By means of this position of the pivot point 11, the guide handle 10 can run almost horizontally, whereby a diminution of vibration also results at the grip end.

In addition, the Figures show that the guide handle 10 is extended forward at 10*b* beyond the pivot point 11 and there carries counterweights 12. The desired mass distribution can be accomplished with constant handle geometry in a simple manner using these counterweights.

Figure 4:
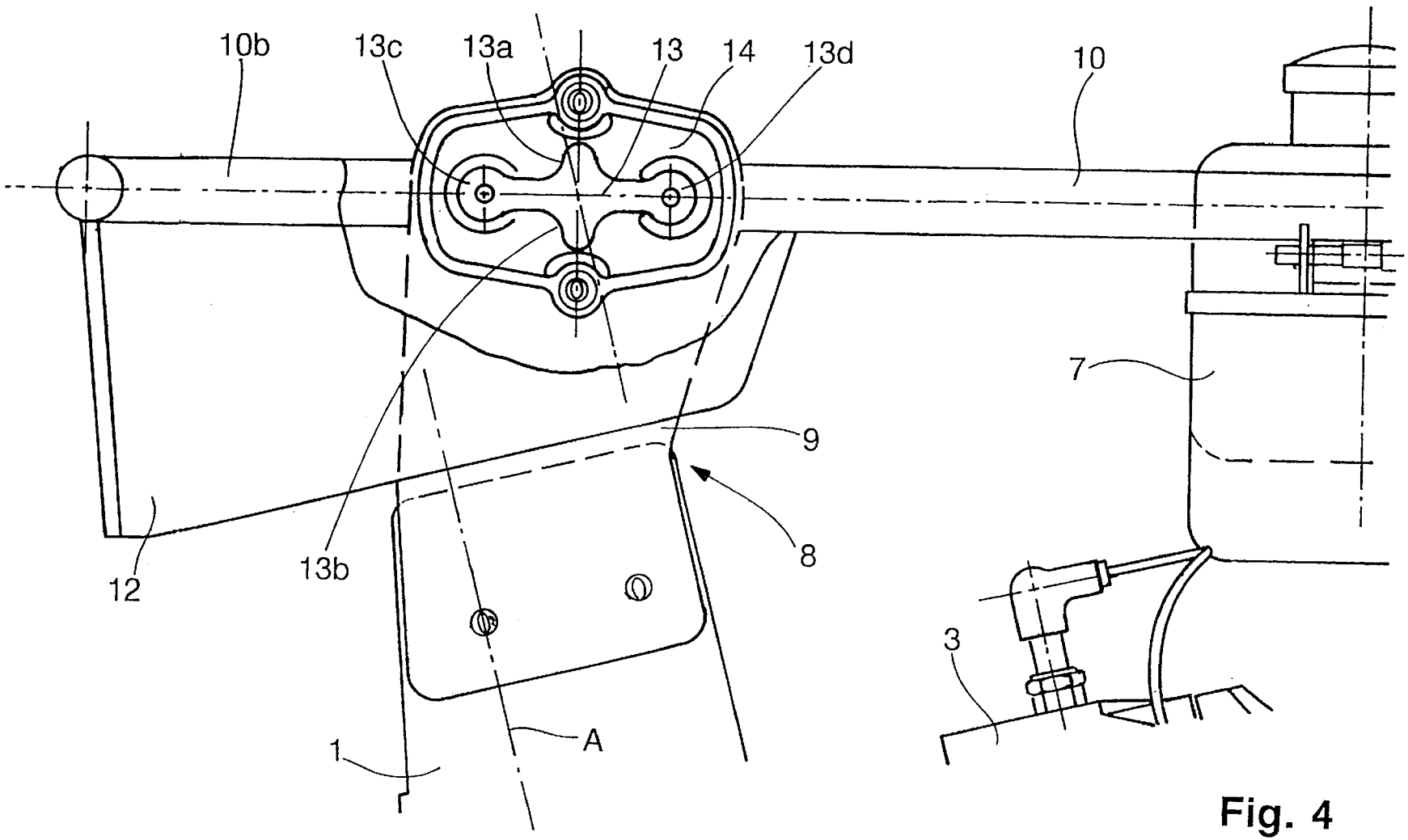
FIG. 4 is an enlarged side view of the tamper head.

FIG. 4 shows an enlarged representation of the pivot point 11 for clarification of the damping built in between the guide handle 10 and the tamper head 8. For this purpose, the guide handle 10 is connected in any given case on both sides with a coupling 13 which has projections jutting outwardly in embodiment shown. The two middle projections 13*a* and 13*b* jutting upward and downward are imbedded in a damping element in the form of a suitable rubber elastic shaped part 14, while the other two projections 13*c* and 13*d* have no or only slight contact with this shaped part in the resting position of the guide handle 10. This has the consequence that the vibration movements between the guide handle and tamper which occur in the course of operation of the tamper are at first damped only on projections 13*a* and 13*b*, and damping on the remaining projections first becomes effective following a certain deflection of the guide handle. One thereby obtains a graduated damping, which has especially favorable ergonomic effects.

The form of the coupling element 13 as well as that of the rubber elastic shaped part 14 is obviously a matter of choice. It is essential only that a part of the damping surfaces first becomes effective following a certain deflection of the guide handle.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A tamper for soil packing, comprising a built-in drive (3) which executes nearly vertical vibrations, a guide handle (10) for holding the tamper by an operator, the guide handle (10) being elastically hinged on a tamper head (8) about a pivot point (11) and having a grip (10*a*) on one end and an extension (10*b*) on another end extending beyond the pivot point (11), the pivot point (11) being displaced from a longitudinal axis (A) in a direction toward the grip (10*a*), wherein at least one of the following relationships is satisfied:

(a) the pivot point (11) is arranged on the tamper head (8) above an imaginary perpendicular (L) extending from the grip (10*a*) to the longitudinal axis (A) of the tamper, and (b) a distribution of mass of the guide handle (10), with the pivot point (11) as an imaginary dividing point, satisfies the following equation:

$$\frac{m_V \cdot l_V \cdot l_{VG}}{m_B \cdot l_B \cdot l_{BG}} = 0.6 - 1.5 \text{ (quotient)}$$

wherein $m_V$=mass of the extension (10*b*) plus attached parts;

$m_B$=mass of the guide handle extending from the point (11) to the grip (10*a*) plus attached parts;

$l_V$=distance between a center of gravity of my and the pivot point (11);

$l_B$=distance between a center of gravity of $m_B$ and the pivot point (11);

$l_{VG}$=distance between the center of gravity of my and the grip (10*a*);

$l_{BG}$=Distance between the center of gravity of $m_B$ and the grip (10*a*).

2. The tamper according to claim 1, wherein the quotient for the mass distribution is approximately between 0.7 and 1.25.

3. The tamper according to claim 2, wherein the quotient for the mass distribution is about 0.8 to 1.15.

4. The tamper according to claim 1, wherein the pivot point (11) is arranged at least approximately 2 cm above the imaginary perpendicular (L).

5. The tamper according to claim 4, wherein the pivot point (11) is arranged about 3 cm to 20 cm above the imaginary perpendicular (L).

6. The tamper according to claim 4, wherein the pivot point (11) is arranged at least about 5 cm above the imaginary perpendicular (L).

7. The tamper according to claim 1, wherein the extension (10*b*) carries a counterweight (12).

8. The tamper according to claim 1, wherein the guide handle (10) is hinged on the tamper head (8) by at least one elastic element (13) having a graduated progressive spring characteristic.

9. The tamper according to claim 8, wherein the graduated progressive spring characteristic is achieved by damping surfaces of the elastic element (13) which first attain a working connection with the guide handle (10) following a certain deflection thereof.

10. A tamper for soil packing, comprising a built-in drive (3) which executes nearly vertical vibrations, a guide handle (10) for holding the tamper by an operator, the guide handle (10) being elastically hinged on a tamper head (8) about a pivot point (11) and having a grip (10*a*) on one end and an extension (10*b*) on another end extending beyond the pivot point (11), the extension (10*b*) carrying a counterweight (12), wherein at least one of the following relationships is satisfied:

(a) the pivot point (11) is arranged on the tamper head (8) above an imaginary perpendicular (L) extending from the grip (10*a*) to a longitudinal axis (A) of the tamper, and (b) a distribution of mass of the guide handle (10), with the pivot point (11) as an imaginary dividing point, satisfies the following equation:

$$\frac{m_V \cdot l_V \cdot l_{VG}}{m_B \cdot l_B \cdot l_{BG}} = 0.6 - 1.5 \text{ (quotient)}$$

wherein $m_V$=mass of the extension (10*b*) plus attached parts;

$m_B$=mass of the guide handle extending from the point (11) to the grip (10*a*) plus attached parts;

$l_V$=distance between a center of gravity of my and the pivot point (11);

$l_B$=distance between a center of gravity of $m_B$ and the pivot point (11);

$l_{VG}$=distance between the center of gravity of $m_V$ and the grip (10*a*);

$l_{BG}$=Distance between the center of gravity of $m_B$ and the grip (10*a*).

* * * * *

UNITED STATES PATENT AND TRADEMARK OFFICE

CERTIFICATE OF CORRECTION

PATENT NO. : 5,645,370
DATED : July 8, 1997
INVENTOR(S) : Arno Zürbes and Helmut Rötsch It is certified that error appears in the above-identified patent and that said Letters Patent is hereby corrected as shown below:

Column 4,
Lines 26 and 30, change "my" to -- $m_v$ --

Column 6,
Line 3, change "my" to -- $m_v$ --

Signed and Sealed this

Fifth Day of August, 2003

JAMES E. ROGAN
*Director of the United States Patent and Trademark Office*